US008469683B2

(12) United States Patent
Armenio et al.

(10) Patent No.: US 8,469,683 B2
(45) Date of Patent: Jun. 25, 2013

(54) VARIABLE-DISPLACEMENT VANE OIL PUMP

(75) Inventors: Giacomo Armenio, Leghorn (IT); Massimiliano Lazzerini, Cecina (IT); Nicola Novi, Pisa (IT); Raffaele Squarcini, Leghorn (IT)

(73) Assignee: Pierburg Pump Technology Italy S.p.A., Lanciano (IT)

( * ) Notice: Subject to any disclaimer, the term of this patent is extended or adjusted under 35 U.S.C. 154(b) by 799 days.

(21) Appl. No.: 12/312,884

(22) PCT Filed: Nov. 28, 2007

(86) PCT No.: PCT/IB2007/003658

§ 371 (c)(1),
(2), (4) Date: Feb. 18, 2010

(87) PCT Pub. No.: WO2008/065513

PCT Pub. Date: Jun. 5, 2008

(65) Prior Publication Data

US 2010/0135835 A1 Jun. 3, 2010

(30) Foreign Application Priority Data

Nov. 29, 2006 (IT) ..... BO2006A0811

(51) Int. Cl.
*F03C 2/00* (2006.01)
*F01C 1/00* (2006.01)

(52) U.S. Cl.
USPC ..... 418/26; 418/27; 418/31

(58) Field of Classification Search
USPC ..... 418/24–27, 30–31; 417/219–221; 92/12.1
See application file for complete search history.

(56) References Cited

U.S. PATENT DOCUMENTS

| | | | | |
|---|---|---|---|---|
| 2,538,194 | A * | 1/1951 | Ferris | 418/26 |
| 2,612,114 | A | 9/1952 | Ernst | 103/120 |
| 3,465,682 | A | 9/1969 | Hartmann | 103/120 |
| 4,340,338 | A * | 7/1982 | Lemke | 418/26 |
| 4,673,341 | A * | 6/1987 | Bristow | 418/26 |
| 4,950,137 | A | 8/1990 | Fischer et al. | 418/26 |
| 5,236,319 | A | 8/1993 | Fischer et al. | 418/26 |
| 6,527,525 | B2 * | 3/2003 | Kasmer | 418/31 |
| 7,344,361 | B2 * | 3/2008 | Kiefer | 417/220 |

FOREIGN PATENT DOCUMENTS

| | | |
|---|---|---|
| DE | 10130597 A1 | 1/2003 |
| EP | 1790855 A2 | 5/2007 |
| FR | 2764336 | 6/1997 |
| JP | 62294790 | 12/1987 |
| JP | 2000104672 | 4/2000 |

OTHER PUBLICATIONS

International Search Report dated Aug. 12, 2008 in the corresponding PCT/IB2007/003658.

* cited by examiner

*Primary Examiner* — Hoang Nguyen
(74) *Attorney, Agent, or Firm* — Ohlandt, Greeley, Ruggiero and Perle, L.L.P.

(57) ABSTRACT

A variable-displacement oil pump wherein between a projection of a mobile ring and a corresponding driving chamber and between a protrusion (again of the mobile ring) and a corresponding guiding seat, respectively, there are placed corresponding devices adapted to decrease the effects of the friction between the projections on the mobile ring and the corresponding seats obtained on a main body of the pump itself.

6 Claims, 3 Drawing Sheets

VARIABLE-DISPLACEMENT VANE OIL PUMP

TECHNICAL FIELD

The present invention relates to a variable-displacement vane oil pump.

BACKGROUND ART

In general, a variable-displacement vane oil pump comprises:

a main body presenting a cavity;

a mobile ring, accommodated in the cavity, within which there is, in turn, a hub adapted to turn about an axis; the hub is provided with a plurality of vanes, each of which is adapted to slide in a corresponding slot obtained in the hub itself.

Normally, there is further provided a moving device of the mobile ring according to a driving pressure between a central position on the rotation axis of the hub towards a predetermined extreme position, eccentric with respect to the rotation axis of the hub itself.

Furthermore, in the specific variable-displacement vane pump described and claimed in international patent application WO 03/023228 (PIERBURG), the moving device comprises a driving chamber made on a wall of the cavity and an overhanging projection of the mobile ring. The projection is adapted to slide in the driving chamber due to a driving pressure present in the driving chamber itself. Furthermore, in the pump described in the aforesaid document, there is a guiding device for guiding the mobile ring in the cavity. Furthermore, the guiding device comprises a protrusion coupled to a guiding seat, and a spring arranged inside the guiding seat, which elastically acts on the mobile ring.

The text of the aforesaid patent application WO 03/023228 (PIERBURG) must be considered to all effects an integral part of the present description.

Currently, the contact between mobile ring and main body of the pump occurs through a prismatic contact (surface-on-surface). This means that there is no lubrication between the two surfaces because there is direct contact between them.

During the life of the pump and in highly loaded engine applications, a direct contact between surfaces may lead as an undesired collateral effect to an initial adhesive wear followed by a subsequent abrasive wear.

Although, actually, catastrophic events caused by the contact between surfaces in highly loaded engine applications of the variable eccentricity vane pump have not yet been reported, it appears appropriate to introduce the innovations object of the present description.

Incidentally, in this context, "highly loaded engine applications" mean the applications in which the pump is subjected to very fast rotation speeds and/or very high pressures (i.e. some sports car engines or some truck engines).

DISCLOSURE OF INVENTION

Therefore, it is the object of the present invention to make a variable-displacement vane oil pump which improves the one described in international patent application WO 03/023228 (PIERBURG) and which at the same time is easy and cost-effective to manufacture.

According to the present invention there is thus made a variable-displacement rotary vane pump with the features claimed in the appended claims.

BRIEF DESCRIPTION OF THE DRAWINGS

The present invention will now be described with reference to the accompanying drawings, which illustrate a non-limitative embodiment thereof, in which.

BEST MODE FOR CARRYING OUT THE INVENTION

Figure 1:
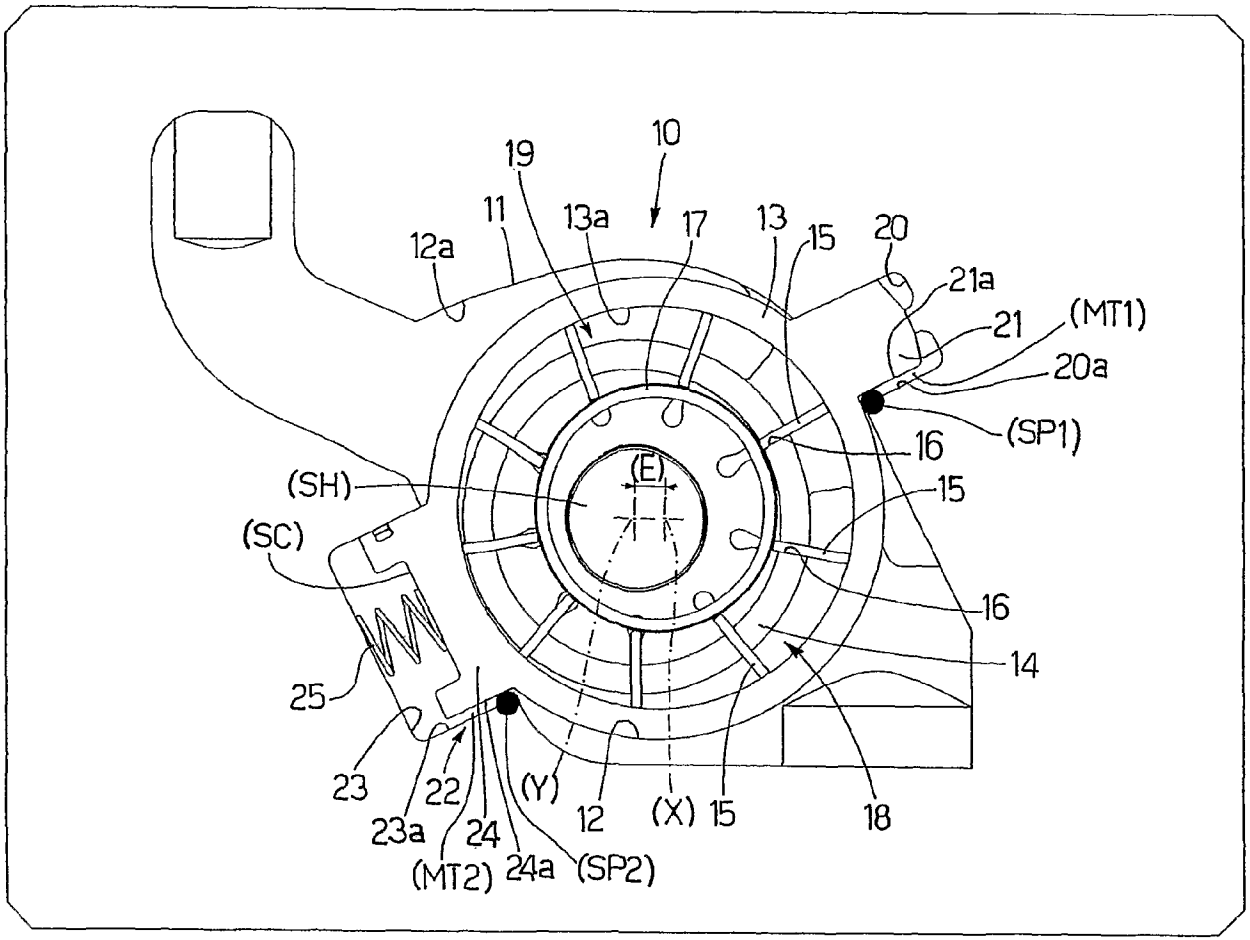
FIG. 1 shows a first embodiment of a variable-displacement vane oil pump object of the present invention.

In FIG. 1, numeral 10 generically shows as a whole a variable-displacement vane oil pump object of the present invention.

The pump 10 comprises a main body 11 presenting a cavity 12 in which a mobile ring 13 is accommodated.

In the central part of the cavity 12 and within the mobile ring 13 there is a hub 14 provided with vanes 15, each of which is adapted to slide in a corresponding slot 16 obtained in the hub 14. The external ends of the vane 15 slide on an internal wall 13*a* of the mobile ring 13.

The volume defined by the internal wall 13*a* of the mobile ring 13 is a circular-base cylinder in the three embodiments shown in the accompanying figures.

Furthermore, the internal end of each vane 15 rests on a floating ring 17 within the hub 14.

In known manner, the hub 14 is rotationally integral with a shaft (SH) with which it is integral.

The aforesaid volume defined by the mobile ring 13 is characterized by its centre (X), while the hub 14 presents its own centre (Y) about which the shaft SH and thus the hub 14 itself turn.

As known, when the centre (X) of the mobile ring 13 coincides with the axis (Y) of the hub 14 (and of the shaft (SH)) the pump 10 is at its "dead point" and there is no pumping of oil from an intake pipe 18 towards a delivery pipe 19.

Therefore, in order to have pumping there must be an eccentricity (E) given by the distance between the two axes (X), (Y).

A pressurized oil feeding channel (not shown) hydraulically connects the delivery pipe 19 to a driving chamber 20, obtained in the wall 12*a* of the cavity 12. The driving chamber 20 is adapted to contain a projection 21 overhanging from the mobile ring 13. Evidently, in the driving chamber 20 there is the same driving pressure as the oil in the delivery pipe 19.

As shown in the accompanying figures, a guiding device 22 of the mobile ring 13 is provided in a diametrically opposite portion of the projection 21 (and of the driving chamber 20) with respect to the axes (X), (Y).

In turn, the guiding device 22 comprises a guiding seat 23 and a protrusion 24 (provided with an opening (SC)), which protrudes from the mobile ring 13 into the guiding seat 23 itself. The guiding device 22 further comprises a helical spring 25.

Furthermore, the helical spring 25, partially accommodated in the opening (SC), elastically stresses the protrusion 24 and thus also the mobile ring 13.

In use, the elastic force produced by the helical spring 25 serves to contrast the movements induced on the mobile ring 13 by the pressurized oil present in the driving chamber 20.

FIG. 1 shows a first embodiment of the present invention.

In this first embodiment, a first pin (SP1) driven into the main body 11 has been used to limit the friction between a wall 20*a* of the driving chamber 20 and a wall 21*a* of the projection 21; such first pin (SP1) slightly raises the surface 21*a* from the surface 20*a* creating a first gap (MT1).

Similarly, again in the first embodiment in FIG. 1, a second pin SP2, also driven into the main body 11 so as to slightly raise the surface 24*a* from the surface 23*a* and create a second gap (MT2), is used to limit the friction between a wall 23*a* of the guiding seat 23 and a wall 24*a* of the protrusion 24.

Thus, the contacts between the surface 21*a* and the first pin (SP1) and between the surface 24*a* and the second pin (SP2), respectively, continue to be sliding, but in the two gaps (MT1), (MT2) there is a slight thrust of the oil on the projection 21 and on the protrusion 23, respectively, which considerably decreases the involved loads.

In other words, although a proper lubrication is not established in the gaps (MT1), (MT2) the involved loads are smaller and the oil cools the walls 20*a*, 21*a*, 23*a*, 24*a*, with consequent positive effects on the general operation of the system.

Figure 2:
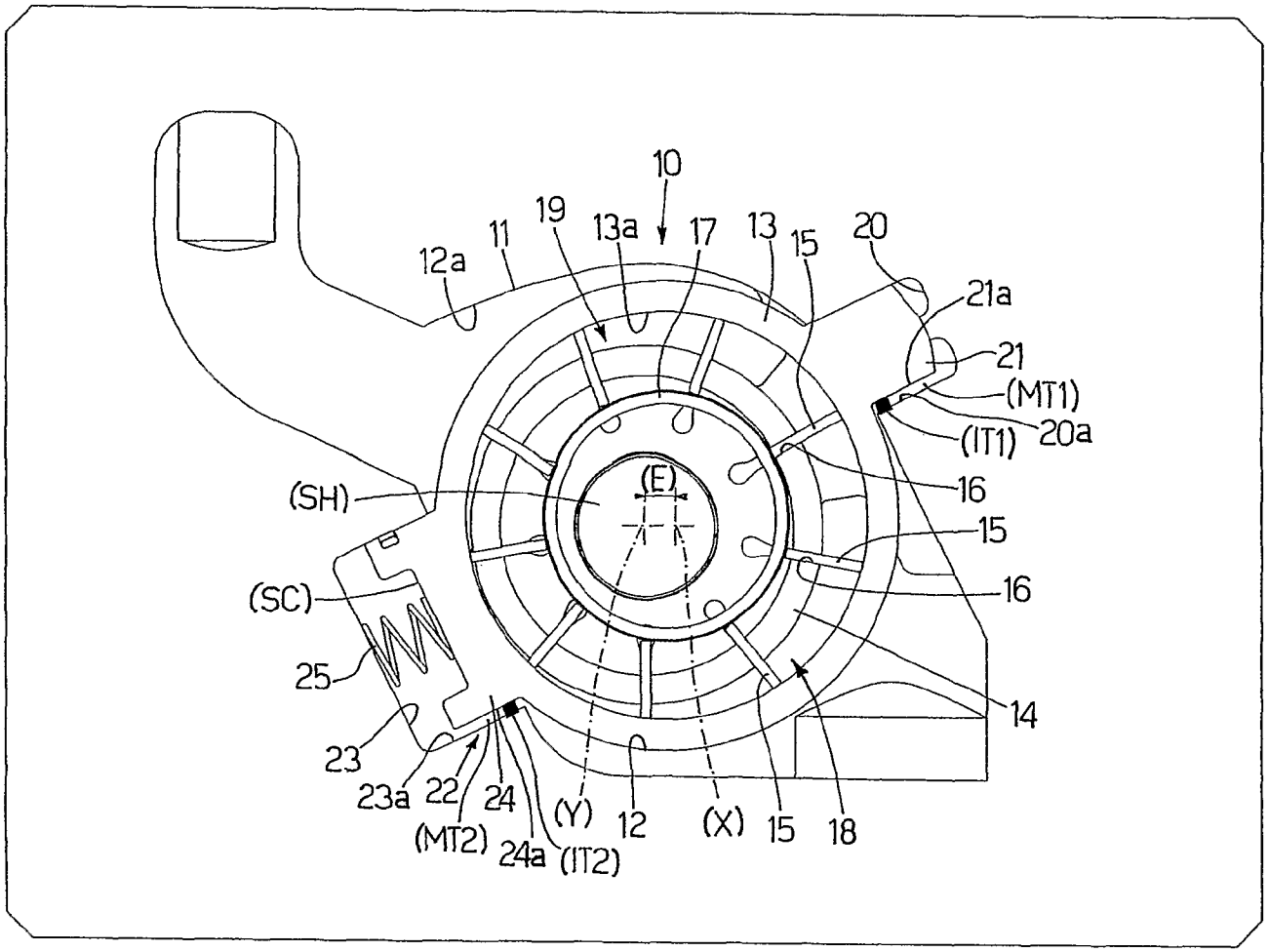
FIG. 2 shows a second embodiment of a variable-displacement vane oil pump object of the present invention.

In the second embodiment shown in FIG. 2, two inserts (IT1), (IT2) instead of the pins (SP1), (SP2) were used. Also in this case, the contact between the surface 21*a* and the insert (IT1) and between the surface 23*a* and the insert (IT2), respectively, continues to be of the sliding type but the friction between the involved surfaces is considerably lower.

Figure 3:
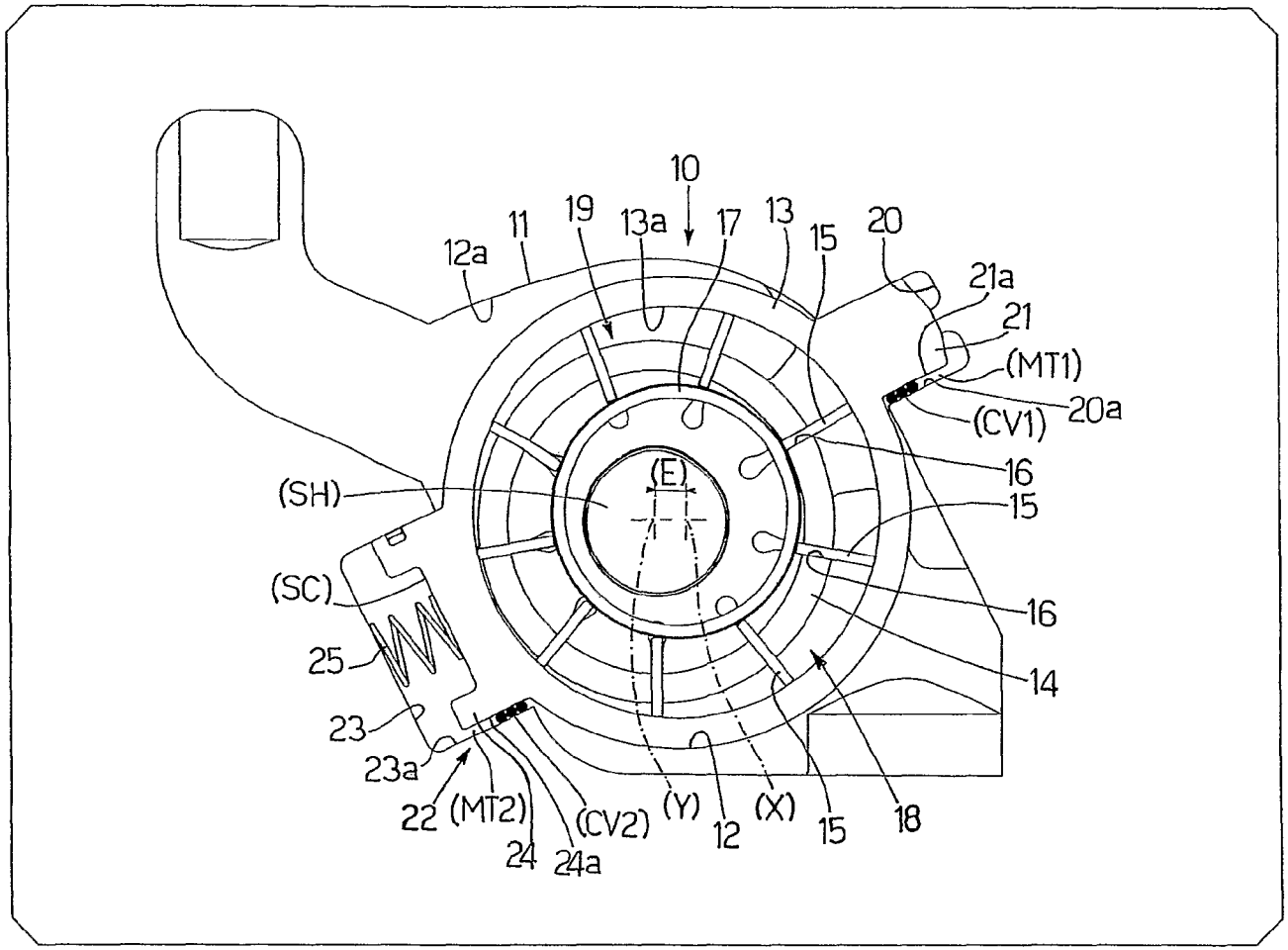
FIG. 3 shows a third embodiment of a variable-displacement vane oil pump object of the present invention.

Finally, in the third embodiment shown in FIG. 3, the contact is no longer sliding because in this case rolling elements (CV1), (CV2), respectively, were used. In the case in point, in the example shown in FIG. 3, the rolling elements (CV1), (CV2) are rollers. The contact is no longer of the sliding type and this allows considerable advantages.

Indeed, the main advantage of the solutions adopted in the pump object of the present invention is that due to the considerable decrease of wear between the parts in reciprocally relative movement (parts belonging to the main body of the pump and to the mobile ring), specifically between a projection (of the mobile ring) and the corresponding driving chamber and between a protrusion (again of the mobile ring) and the corresponding guiding seat.

| Reference number list: | |
|---|---|
| 10. | Vane oil pump |
| 11. | Main body (of the pump 10) |
| 12. | Cavity |
| 12a. | Wall (of the cavity 12) |
| 13. | Mobile ring |
| 14. | Hub |
| 15. | Vane |
| 16. | Slot (in the hub 14) |
| 17. | Floating ring |
| 18. | Intake pipe |
| 19. | Delivery pipe |
| 20. | Driving chamber |
| 20a. | Wall (of the driving chamber 20) |
| 21. | Projection |
| 21a. | Wall (of the projection 21) |
| 22. | Guiding device |
| 23. | Guiding seat |
| 23a. | Wall (of the guiding seat 23) |

-continued

| Reference number list: | |
|---|---|
| 24. | Protrusion |
| 24a. | Wall (of the protrusion 24) |
| 25. | Helical spring |
| (E). | Eccentricity |
| (CV1). | Rolling element |
| (CV2). | Rolling element |
| (IT1). | Insert |
| (IT2). | Insert |
| (MT1). | First gap (between the surfaces 20a and 21a) |
| (MT2). | Second gap (between the surfaces 23a and 24a) |
| (SC). | Opening (in the protrusion 24) |
| (SH). | Shaft |
| (SP1). | First pin |
| (SP2). | Second pin |
| (X). | Axis (of the volume defined by the mobile ring 13) |
| (Y). | Axis (of the hub 14) |

The invention claimed is:

1. A variable-displacement oil vane pump comprising:

a main body presenting a cavity;

a mobile ring, accommodated in said cavity, within which there is a hub adapted to turn about an axis; said hub being provided with a plurality of vanes, each of which is adapted to slide in a corresponding slot obtained in the hub;

a moving means of the mobile ring that moves between a position centered on the rotation axis of the hub and a predetermined extreme position, eccentric with respect to the rotation axis of the hub itself; said moving means comprising a driving chamber made on a wall of said cavity and a projection overhanging from the mobile ring, said projection being adapted to slide in said driving chamber due to a driving pressure present in said driving chamber;

a guiding means for guiding the mobile ring in said cavity; said guiding means comprising a protrusion coupled with a guiding seat, and elastic means, on the inside of said guiding seat, and elastic means, on the inside of said guiding seat, which elastically act on the mobile ring;

friction reducing means disposed between said projection and said driving chamber and said protrusion and said guiding seat adapted to decrease the effects of the friction, wherein between said projection and the driving chamber and, between said protrusion and said guiding seat, there are created corresponding oil gaps adapted to create a thrust on said projection and, respectively, on said protrusion.

2. The pump according to claim 1, wherein said friction reducing means comprise at least one pin.

3. The pump (10) according to claim 2, wherein said at least one pin is driven into the main body.

4. The pump according to claim 1, wherein said friction reducing means comprise at least one insert.

5. The pump according to claim 1, wherein said friction reducing means comprise at least one rolling element.

6. The pump according to claim 1, wherein said friction reducing means comprise a first pin that contacts a surface of a wall of said projection and a second pin that contacts a surface of a wall of said protrusion forming the oil gaps.

* * * * *